US006145760A

United States Patent [19]

Harris

[11] Patent Number: 6,145,760

[45] Date of Patent: Nov. 14, 2000

[54] PRESSURE COMPENSATOR FOR AN IRRIGATION SPRINKLER

[75] Inventor: Shane Antony Harris, Beverley, Australia

[73] Assignee: Toro Australia PTY Ltd., Australia

[21] Appl. No.: 09/234,403

[22] Filed: Jan. 20, 1999

[30] Foreign Application Priority Data

Jan. 20, 1998 [AU] Australia ..... PP 1416

[51] Int. Cl.[7] ..... B05B 1/30

[52] U.S. Cl. ..... 239/533.1; 239/542; 239/570

[58] Field of Search ..... 138/37, 46; 239/533.1, 239/533.13, 542, 570; 137/843, 352; 251/205, 531

[56] References Cited

U.S. PATENT DOCUMENTS 3,777,980 12/1973 Allport ..... 239/542
4,502,631 3/1985 Christen ..... 239/542
4,724,870 2/1988 Molbae et al. ..... 138/46

*Primary Examiner*—Andres Kashnikow
*Assistant Examiner*—Christopher S. Kim
*Attorney, Agent, or Firm*—Brown, Martin, Haller & McClain, LLP

[57] ABSTRACT

This invention relates to a pressure compensator (11) for use with irrigation devices (8) where the pressure compensator (11) is used to control a flow of water. The compensator (11) comprises elastomeric disc (15), a substantially concave seating surface (13) which is covered by the disc (15), the seating surface (13) having a peripheral edge (22) against which the disc (15) locates, and at least one recess portion (26) on the periphery on the seating surface (13) that results in an aperture between the disc (15) and the seating surface (13) when no force is applied to the disc (15), and which provides flow control resulting from the edge of the disc (15) flexing into the recess (26) when force is applied to the disc (15). Significantly less force is required to flex the edge of the disc (15) into the recess (26) which results in control of fluid flow at much lower pressures by comparison known fluid control devices.

4 Claims, 2 Drawing Sheets

PRESSURE COMPENSATOR FOR AN IRRIGATION SPRINKLER

This invention relates to a means of compensating for pressure variations in water supply to irrigation sprinklers, and in particular is directed to a means of providing effective pressure compensation at low supply pressures, and effective flushing of blockages.

BACKGROUND OF THE INVENTION

The use of elastomeric discs to control flow rates as a result of increased pressure is well-known. Elastomeric discs are positioned over apertures which enable the control of flow rate of water past the disc as the pressure increases due to flexing of the disc. Ordinarily, the disc is positioned over a recess and has a water passageway which is progressively reduced in diameter as the disc flexes further into the recess.

There are variations on the shape of the apertures within which the disc flexes into, but the main principle of operation is the continual reduction in flow passage diameter as the pressure increases.

The main reason for using pressure compensators on irrigation equipment is to ensure that each sprinkler discharges at substantially the same volume flow rate. Supply pressure along a distribution line can vary considerably due to friction losses, resulting in a significantly lower pressure at the end of a long run. In addition, irrigation lines installed on a slope with a significant height variation from one end to the other will also suffer considerable pressure variations along the line. This would result in some areas of a crop receiving more water than others unless some form of pressure compensation is used.

Most pressure compensators using an elastomeric disc rely on tension in the disc resulting from flexion to form a concave shape. In order to achieve flow control at low pressures, a relatively large diameter disc of thin material is required. This results in tensions which are considerably less by comparison to smaller diameter discs.

However, a disadvantage with the use of large diameter discs is the fact that they require large diameter sprinkler bodies. This is not always desirable, and in some instances it may be essential to make use of a smaller diameter elastomeric disc.

Accordingly, it is an object of this invention to provide a means of better flow control at lower pressures, and to also provide a means of flow control which would be suited to smaller elastomeric compensating discs.

A further problem with existing pressure compensators is blockage and the difficulty in removing blockages. When the water supply is turned off, the elastomeric disc flattens so that the initial water flow, when it is next turned on, will flush away any blockages. However, the channels are often very small and therefore do not flush adequately.

Also, the use of such small channels requires a great degree of accuracy in manufacture to ensure consistent flow control.

It is a further aspect of the invention to overcome the above problems.

SUMMARY OF THE INVENTION

Accordingly, in its broadest form, the invention is a pressure compensator for use with an irrigation device comprising:

an elastomeric disc a substantially concave seating surface which is covered by said disc, said seating surface having a peripheral edge against which said disc locates, and at least one recess on said seating surface extending inwardly from the periphery towards the center of said seating surface, said recess having an arcuate edge at the periphery of said seating surface that results in a segment shaped opening between the periphery of both said disc and said seating surface when no force is applied to said disc and which provides flow control resulting from the edge of said disc flexing into said recess when force is applied to said disc.

The basic aim of the invention is to provide a different form of disc flexion for flow control which can occur at much lower pressures by comparison to the normal concave flexion which is used in known pressure compensators.

The recess or recesses allow the elastomeric disc flexing in a manner which requires less force to cause significant amounts of deflection. This therefore enables flow control to be achieved at lower operation pressures. Preferably, the recess or recesses have an arcuate edge at the periphery of the seating surface.

The recess may also have a plurality of notches which extend part-way into the seating surface. These notches provide a further degree of flow control as the elastomeric disc flexes into the recesses. These notches provide further flow control during initial stages of flexing of the disc. Further flexure will then cause the notches and the recess or recesses to be closed off which will then prevent flow past this portion of the elastomeric disc. Once this occurs, then other flow control arrangements such as a radial channel of reducing area may be used.

Rather than using very fine or small width radial channel, the inventor has found that the use of a large width and deeper channel of greater length provide adequate flow control. The advantage of a larger channel is that it is less likely to block, any blockage will clear more readily, and it will be easier to make due to being less sensitive to dimensional variation.

The elastomeric disc may be used in any number of different shapes. Preferably, the disc is circular, but a square or elliptical shape may also be used and be included within the meaning of the disc.

A further advantage of the recess or recesses is that it provides a greater cross-sectional area for the initial flushing flow. This in turn results in a greater volume flow of flushing fluid which will be more likely to clear any blockage.

DESCRIPTION OF THE DRAWINGS

In order to fully understand the invention, a preferred embodiment will be described. However, it should be realised that the invention is not to be confined or restricted to the precise details of this embodiment.

The embodiment is illustrated in the accompanying representations which.

DESCRIPTION OF THE PREFERRED EMBODIMENT

Figure 1:
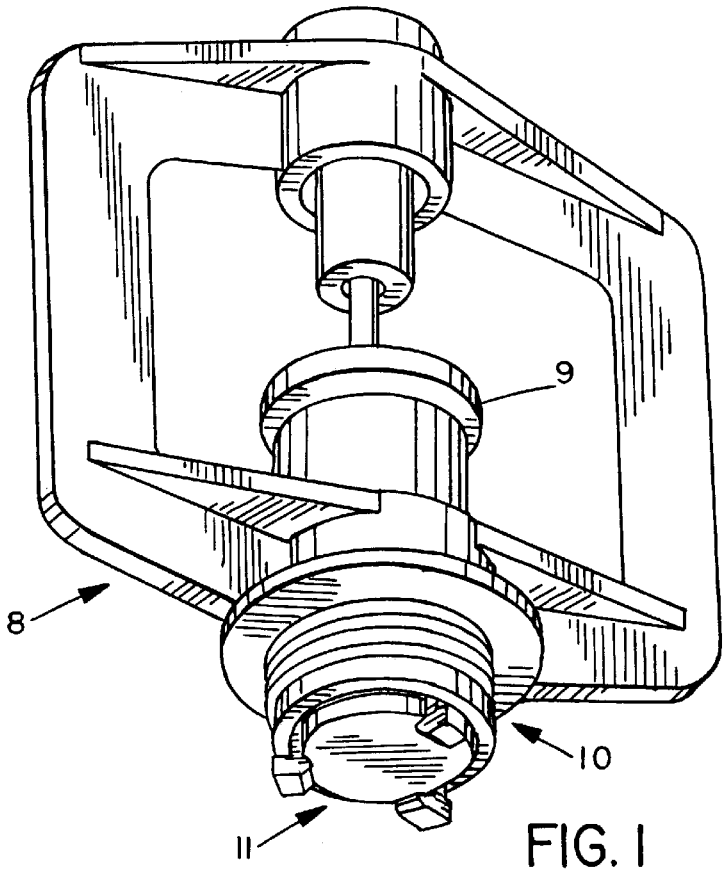
FIG. 1 shows a perspective view of a sprinkler incorporating a pressure compensator according to the invention.
Figure 2:
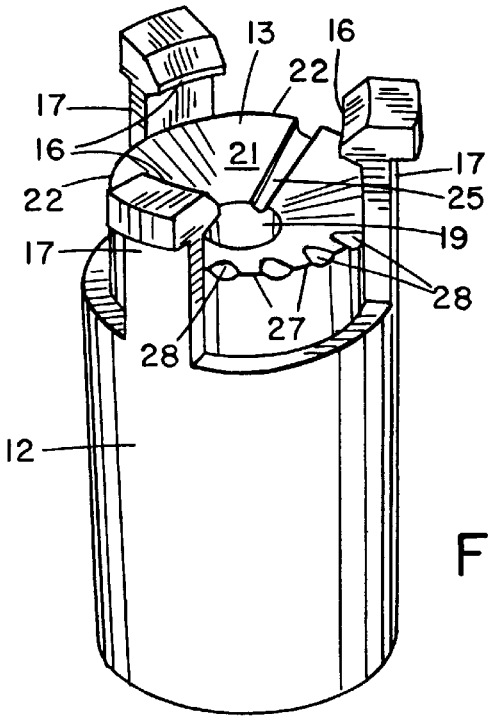
FIG. 2 shows a perspective view of a component used in the sprinkler illustrated in FIG. 1 that includes a seating surface.
Figure 5:
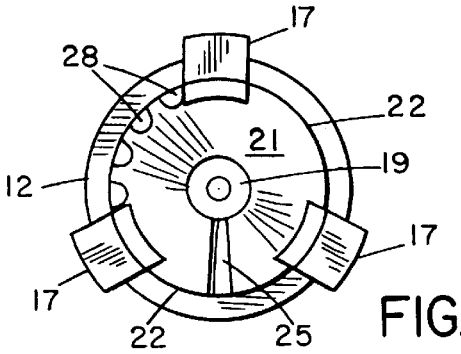
FIG. 5 shows a top view of the component illustrated in FIG. 2.
Figure 3:
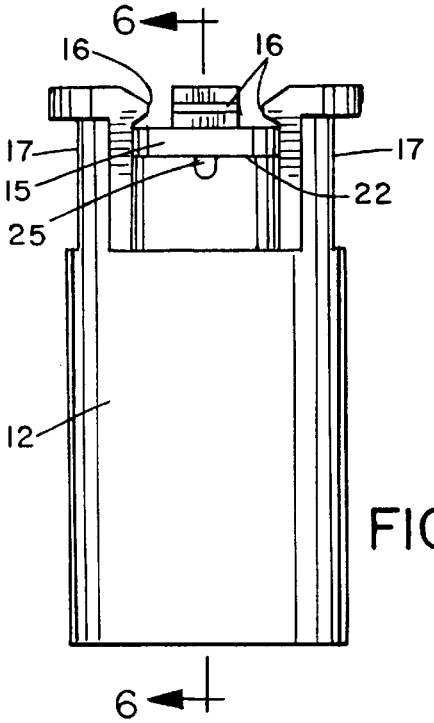
FIG. 3 shows a side view of the component shown in FIG. 2 and an elastomeric disc located on the seating surface.

FIG. 1 shows a perspective view of a sprinkler 8. The sprinkler 8 is typical of miniature sprinklers which distribute water via a rotor 9. The sprinkler has a fluid inlet 10 within which the pressure compensator 11 locates.

The pressure compensator comprises two components. The first is a moulded body 12 which includes the seating surface 13. An elastomeric disc 15 is positioned over the seating surface 13, and is held in place by flanges 16 on posts 17.

An aperture 19 is formed in the centre of the seating surface 13 and allows water flow through a nozzle 20 that produces a jet of water that impacts against rotor 9.

The elastomeric disc 15 locates over seating surface 13 which comprises a concave recess formed by a conical wall 21 and a peripheral edge 22. A channel 25 extends from the peripheral edge 22 to the aperture 19 through which the metered water supply flows to the nozzle 20. Channel 25 is significantly larger by comparison to channels used in known pressure compensators.

The cross-sectional area of the channel 25 decreases as it extends towards the aperture. As the supply pressure increases, the disc 15 flexes into the conical recess of the seating surface 13. As the disc 15 seals against the conical wall 21, ingress for water is mainly via the channel 25. Accordingly, the degree of flexion of the disc 15 determines the extent of contact of the disc 15 along the channel 25 and therefore the effective area and length through which fluid can flow. Obviously, maximum deflection of the disc 15 will result in minimum aperture size and maximum channel length in the channel 25 and therefore the greater restriction to flow.

The above description is effective once the fluid supply pressure reaches a certain pressure. Below this pressure, there is very little flexion of the disc 15, which in turn results in no pressure compensation below this given pressure.

Figure 4:
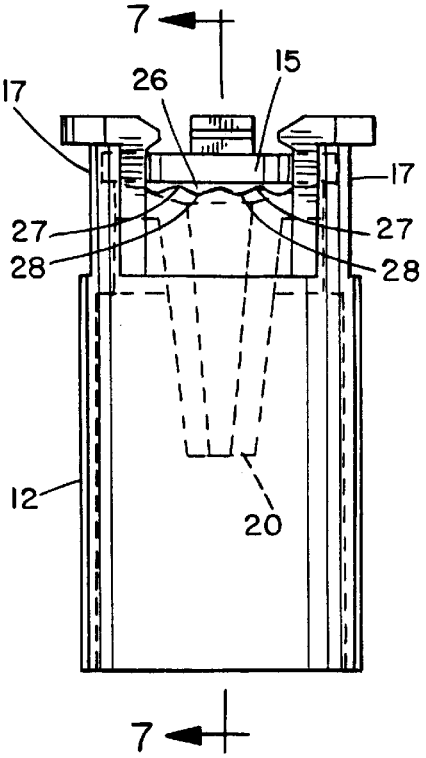
FIG. 4 shows a further side view of the component illustrated in FIG. 2 and an elastomeric disc.
Figure 6:
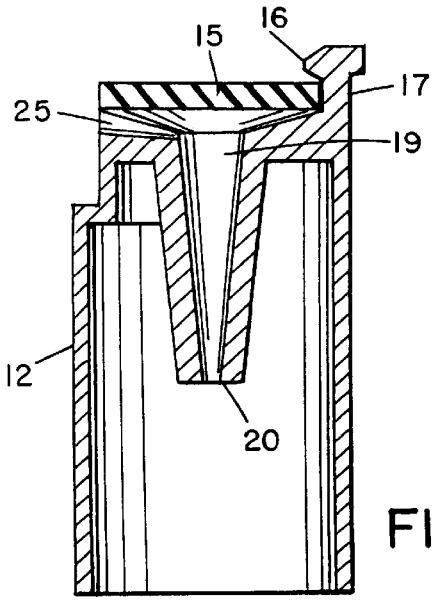
FIG. 6 shows a cross-sectional view of the component illustrated in FIG. 3 and the elastomeric disc along section lines 6—6.
Figure 7:
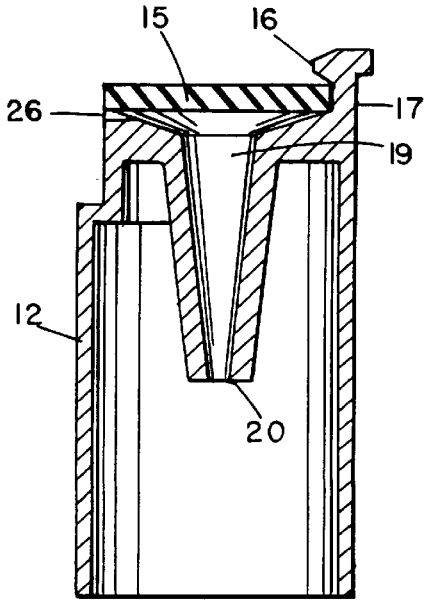
FIG. 7 shows a cross-sectional view of the component illustrated in FIG. 4 and the elastomeric disc about section lines 7—7.

As best illustrated in FIG. 4, the peripheral edge 22 and a portion of the conical wall 21 may be provided with a recess 26 which creates a segment shaped aperture between the peripheral edge of the seating surface 13 and the disc 15 when no force is applied to the disc 15. As seen in FIG. 4, an arcuate edge 27 is provided between an adjacent pair of posts 17 which results in the segment shaped aperture when the disc 15 is placed on the seating surface 13 above the recess 26. The recess 26 is a shallow depression that extends from the peripheral edge 22 towards the aperture 19. The depression tapers both in width and height so that depression ends prior to the aperture 19. In this embodiment, the arcuate edge 27 extends around approximately a quarter of the diameter of the peripheral edge 22. Instead of the disc 15 having to deform into the concave seating surface 13 to commence flow control, the edge of the disc 15 can deform into the recess 26 and arcuate portion 27. This deformation requires much less force toward the periphery of the seating surface 13, and therefore will provide improved degree of flow control at lower pressures.

Obviously, the longer the length of the arcuate portion 27, the lower the force will be that is required to deform the disc 15. The length of the arcuate portion 27 will depend on the pressure at which compensation is required.

In addition to the arcuate edge 27, there may be provided a series of notches 28 which extend a short distance into the recess 26. When the disc 15 is deformed so that it is in contact with the edged of the arcuate portion 27 flow will still occur via the notches 28. Further flexing of the disc 15 into the seating surface 13 will eventually cause the notches 28 to be closed so that the only means of flow control reverts to the channel 25. At this stage, the pressure will obviously be sufficient to force the concave deformation of the disc 15 so that flow control will only be by the channel 25.

Any blockage caused by build-up of debris will be flushed when fluid next flows through the sprinkler. If the pressure compensator 11 blocks through debris lodging in channel 25, recess 26 or notches 28, the initial flow of water will have a good chance of clearing the blocking material. The large area between the disc 15 and the arcuate edge 27 allows a forceful initial flow of water through the recess 26 and channel 25. This flushing flow will continue until the disc 15 starts to deform.

In addition the large water flow allowed by the arcuate edge 27, the channel 25 is large in width which also aids in the clearance of any blockage. The use of a large channel 25 also means that manufacturing tolerances do not need to be so fine.

As will be seen from the above description, the invention provides a unique way of achieving flow control when using an elastomeric disc. Obviously, one advantage of the invention is the ability to have flow control at low operating pressures while at the same time minimising the width or diameter of the elastomeric disc. This will in turn result in a more compact design for the irrigation device. The design also provides improved flushing to clear blockages.

The pressure compensating device as described above will be capable of being used in a number of irrigation devices such as drip emitters or rotating nozzle-style sprinklers. The basic operating principle will remain the same regardless of the irrigation device used.

The claims defining the invention are as follows:

1. A pressure compensator for use with an irrigation device, comprising:

an elastomeric disc;

a substantially concave seating surface which is covered by said disc, said seating surface having a peripheral edge against which said disc locates;

at least one recess on said seating surface extending inwardly from the peripheral edge towards the center of said seating surface, said recess having an arcuate edge at the periphery of said seating surface that results in a segment shaped opening between the periphery of both said disc and said seating surface when no force is applied to said disc and which provides flow control resulting from the edge of said disc flexing into said recess when force is applied to said disc; and said arcuate edge having a plurality of notches that partly extend into said seating surface.

2. A pressure compensator according to claim 1 wherein said disc is circular and said seating surface is circular.

3. A pressure compensator according to claim 1 wherein said at least one recess partly extends into said seating surface so that said flow past said at least one recess is prevented upon sufficient flexing of said disc into said seating surface.

4. A pressure compensator according to claim 1 wherein the recess has an angular width at the periphery of the seating surface extending around approximately one quarter of the diameter of the seating surface.

* * * * *

UNITED STATES PATENT AND TRADEMARK OFFICE

CERTIFICATE OF CORRECTION

PATENT NO. : 6,145,760
DATED : November 14, 2000
INVENTOR(S) : Shane Antony Harris It is certified that error appears in the above-identified patent and that said Letters Patent is hereby corrected as shown below:

Column 2,
Line 30, replace "large" with -- larger --

Column 3,
Line 32, replace "greater" with -- greatest --

Signed and Sealed this

Fifth Day of February, 2002

*Attest:*

*Attesting Officer*

JAMES E. ROGAN
*Director of the United States Patent and Trademark Office*